United States Patent [19]

Jung

[11] 3,939,742

[45] Feb. 24, 1976

[54] METHOD AND APPARATUS FOR AUTOMATICALLY CUTTING FABRICS AND THE LIKE

[75] Inventor: Rolf Jung, Waiblingen, Germany

[73] Assignee: Krauss & Reichert Spezialmaschinenfabrik, Fellbach, Germany

[22] Filed: May 13, 1974

[21] Appl. No.: 469,297

[30] Foreign Application Priority Data

May 18, 1973 Germany ..... 2325426

[52] U.S. Cl. ..... 83/56; 83/565; 83/925 CC

[51] Int. Cl.[2] ..... D06H 7/00

[58] Field of Search ..... 83/565, 925 CC, 56; 33/23 G, 23 H, 23 R, 17 R

[56] References Cited

UNITED STATES PATENTS

| | | | |
|---|---|---|---|
| 1,172,058 | 2/1916 | Scheyer | 83/565 X |
| 1,987,799 | 1/1935 | Ryan | 83/565 X |
| 3,017,552 | 1/1962 | Brouwer | 318/39 |
| 3,304,820 | 2/1967 | Müller et al. | 83/925 CC X |
| 3,511,124 | 5/1970 | Bruns | 83/925 CC X |
| 3,766,813 | 10/1973 | Pearl | 83/925 CC X |
| 3,777,604 | 12/1973 | Gerber | 83/925 CC X |

*Primary Examiner*—Frank T. Yost

*Attorney, Agent, or Firm*—Shenier & O'Connor

[57] ABSTRACT

The invention concerns a method for the automatic cutting of fabrics and the like in a cutting plane according to a pattern template which contains the cutting information to be sensed by a sensing device in the form of a single, continuous, intersection-free line which is composed in stages of contour line parts of the pattern parts and of contour line parts of narrow bars which connect the pattern parts, the contour line parts of the pattern parts and the bars meeting together and forming sharp corners, with the help of a cutting device containing a knife, as well as a device for carrying out this process.

4 Claims, 8 Drawing Figures

METHOD AND APPARATUS FOR AUTOMATICALLY CUTTING FABRICS AND THE LIKE

BACKGROUND OF THE INVENTION

Processes for automatically cutting are already known in connection with torch cutting machines as they are known, for example, in shipbuilding for the cutting of sheet metal, in which the combination of the individual cutting parts by bars serves first of all the purpose of holding the parts together during the cutting procedure and of avoiding inaccuracies in the cutting lines in the final separation thereof.

The process described above was, however, also used for the automatic cutting of fabrics, in which the bars served the primary purpose of obtaining a single, continuous, intersection-free line, since the known sensing devices were not suitable for sensing lines containing intersections.

In the known processes for the automatic cutting of fabrics, it proved to be disadvantageous that the bars between the individual pattern parts had to be cut off by hand after completion of the automatic cutting process, which meant an additional working step, in the course of which the danger arose that the individual fabric layers were displaced, so that often several cut parts were damaged in cutting through the bars.

SUMMARY OF THE INVENTION

Starting with this state of the art, the problem forming the basis of this invention lies in suggesting an improved process for the automatic cutting of textile materials, plastic foils, paper and the like, in which one can omit a special working step for cutting of the bars. In this connection, it is assumed that the cutting pattern template provides relatively narrow bars; in this connection it is worth mentioning that it is possible to decrease the width of the bars to approximately 1 mm.

The problem posed is solved by a process of the kind described above and is characterized by the feature that the cutting edge of the knife in the area of the sharp corners runs beyond the point corresponding to the breakpoint of the sensed line of the cutting plane at least to an extent corresponding to the width of the bar and then swings into the new cutting direction.

In carrying out the process according to the invention, by a suitable choice of the sensing device and the cutting apparatus, the movements of the cutting device are controlled in such a manner that the narrow bars between the individual pattern parts are already cut in the course of the automatic cutting either completely or at least so far that subsequently no separate cutting step by hand is any longer required.

It is understood that the expert has numerous possibilities at hand to suitably choose the time lag effect of the sensing device, the sluggishness of the engagement of the cutting device to the control signals of the sensing device, and further details for achievement of the desired result.

For carrying out the process according to the invention, a device has proved to be especially effective which is characterized by the feature that a cutting device is provided with a knife movable around a pivotal axis lying behind the cutting edge of the knife in the direction of cutting and running parallel to it; that the penetration point of the pivotal axis of the knife through the cutting plane always corresponds to the sensed point of the pattern template just effected by the control and that the tangential control of the cutting device works with the penetration point of the pivotal axis of the knife as the reference point.

The penetration point of the pivotal axis of the knife, therefore, always corresponds to the point just sensed with the control working without lag, while with a lag in the controls it corresponds to a previously sensed point, which, at this point in time, is utilized by the control to bring about corresponding movements of the sensing device.

It is understood that the process and the apparatus according to the invention for its use with the chosen form of the pattern template may be used independently of whether the line containing the cutting information is a more or less heavy line or a boundary edge between areas of different coloring, i.e. usually between dark and light areas. The formation of the cutting pattern template in its details solely determines the kind of sensing device to be used, i.e. it determines whether one works with a line or an edge sensor. Furthermore, it should be said that a line to be sensed need not be free of intersections, if the sensing takes place with two sensor elements and the lines cross vertically.

Further details and advantages of the invention are described in detail hereinbelow on the basis of the drawings.

BRIEF DESCRIPTION OF THE DRAWINGS

In the accompanying drawings which form part of the instant specification and which are to be read in conjunction therewith and in which like reference numerals are used to indicate like parts in the various views.

DESCRIPTION OF THE PREFERRED EMBODIMENT

Figure 1:
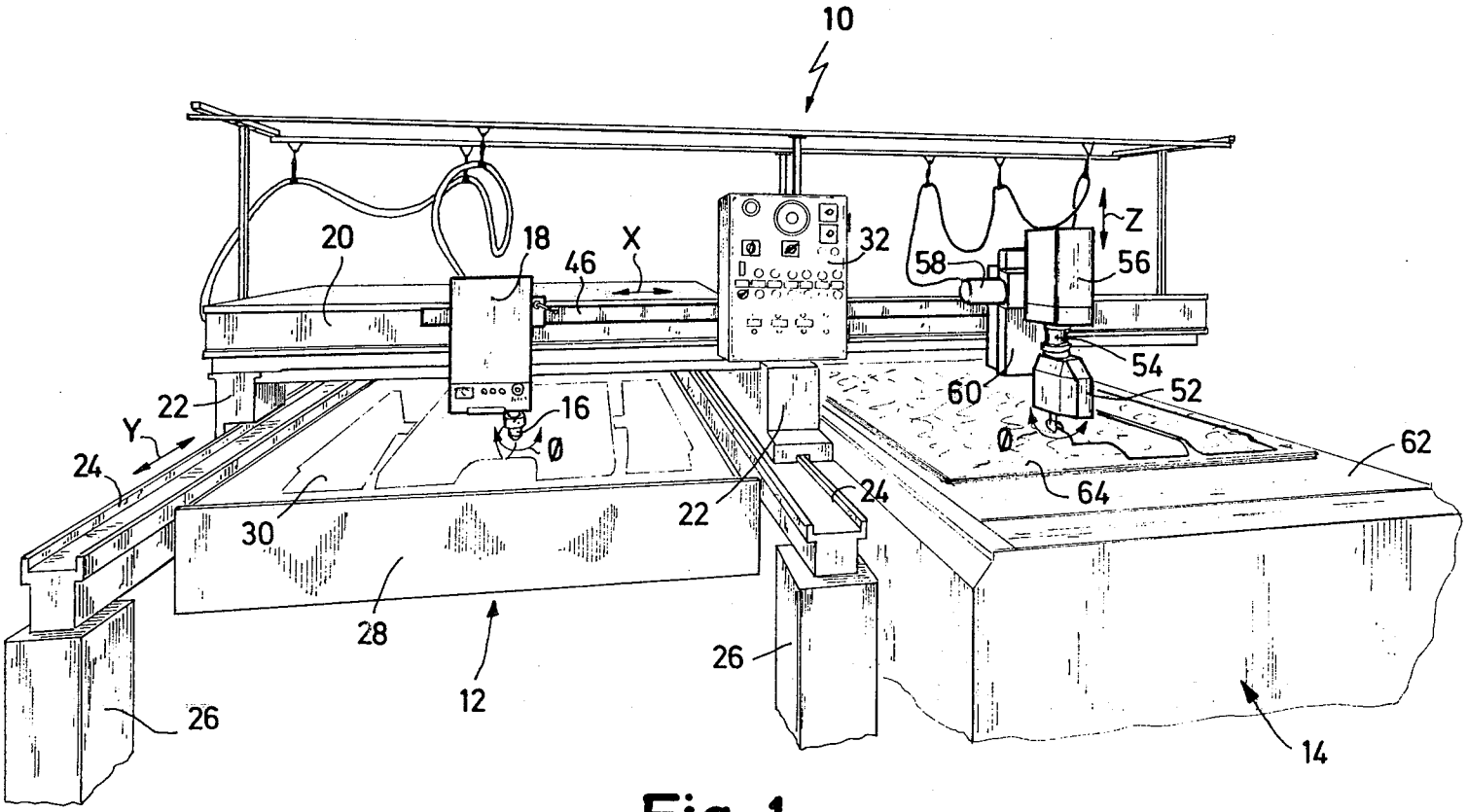
FIG. 1 shows a schematic, perspective overall view of an automatic cutting device for carrying out the process according to the invention.

The entire cutting apparatus illustrated in FIG. 1 is identified by the reference numeral 10. One can see that the cutting device 10 includes two sub-units, namely, a copier or sensing device 12, as well as a cutting device 14. The heart of the sensing device 12 is a photoelectric sensing head 16 with a control 18. The control 18 with the sensing head 16 is movable back and forth in X-direction along a crossbeam 20. The crossbeam 20 on its part is carried by supports 22 with drive rails (not shown), which are movable in Y-direction along drive rails 24. The drive rails 24 rest on wall-like foundations, or as shown in FIG. 1 on columns 26, which are fixed to the floor of a loft space or the like. A cutting pattern template 30 which is to be sensed by the photoelectric sensing head 16 lies on a cutting pattern table 28 situated between the drive rails 24.

After starting the automatic cutting apparatus at the control panel 32, in which in the usual manner a number of control and supervising devices are combined to which no detailed reference is to be made in connection with the present invention, the sensing device 12 works in the following manner which is to be described in greater detail on the basis of FIG. 5 of the drawing.

The photoelectric sensing head 16 can be constructed in a manner similar to that described in U.S. Pat. No. 3,017,552 and as is indicated in the lower part of FIG. 5. As in known sensing devices, the sensing head 16 of the apparatus according to this invention is also provided with a control motor 32, with the help of which the sensing head 16 may always be oriented to the angular position $\phi$ (FIG. 1), in which the optical system is so designed that a reference line of the same runs tangentially to that part of the line of the cutting pattern template 30 which has just been sensed. The control motor 32 is controlled via an amplifier 34 by the output signals of the photoelectric sensing head 16. The turning movement of the sensing head 16 brought about by the control motor 32 is translated over toothed gears to a sine-cosine function transmitter 36. The function transmitter 36 on its part controls a motor 42 for the cross drive via amplifiers 38 and 40, i.e. for driving the sensing head 16 in X-direction along the carrier 20, as well as a motor 44 for driving the sensing head 16 lengthwise, i.e. in Y-direction along the rails 24. As is plain from FIG. 5, the drive in X-direction takes place with the help of a pinion 48 working together with a toothed rack 46, while the drive in Y-direction takes place with the aid of a drive wheel 50. In the drawing, a reduction gear, as well as a coupling, are indicated between the motors 42 and 44, respectively, and pinion 48 and wheel 50. Such arrangements are usual and will not be described in detail here.

When the sensing head 16 with the help of the described devices follows the line to be sensed of cutting pattern template 30, then there are produced corresponding movements of the cutting apparatus 14 which is located in FIG. 1 to the right of the sensing device 12. The cutting apparatus 14 comprises a knife assembly 52, which is coupled through a swing shaft 54 to a swing motor 56. The swing motor 56, together with the knife assembly 52, is movable upwardly and downwardly in the Z-direction with the help of a motor 58. The motor 58 is fastened to a connecting rod 60 which, with the help of a swallow-tailed guide, is carried to the crossbeam 20, at the other end of which the control device 18 of the sensing device 12 is fixed. Below the knife assembly 52, there is a cutting table 62, on which there is arranged a fabric layer package 64 which is to be cut according to the cutting pattern template.

Automatic cutting machines with a sensing device and a cutting device, as described in the foregoing, are already essentially known to the expert, for example from the U.S. Pat. 3,017,552 and from U.S. patent application Ser. No. 298,350, now U.S. Pat. No. 3,845,942, in which the cutting apparatus, however, in both cases works with a gas cutting torch and not with a knife as is the case in the automatic cutting apparatus discussed here. Similar cutting mechanisms have already been proposed for the cutting of fabrics, paper strips, or the like. The last named cutting mechanisms work with rotating knives, with band-shaped revolving knives, and with oscillating knives.

Figure 2A:
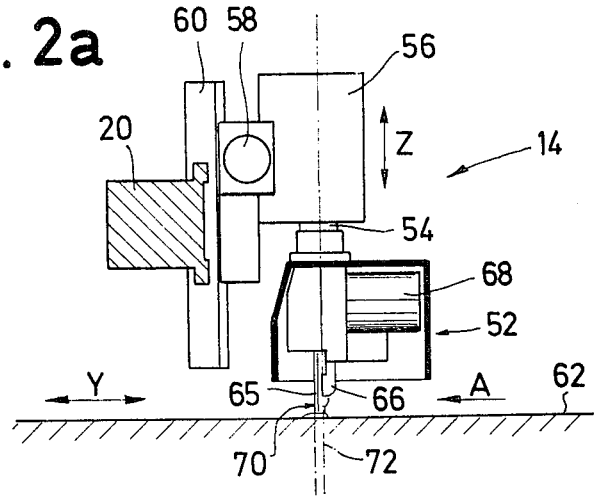
FIGS. 2*a* and 2*b* show enlarged illustrations of the cutting knife and the arrangements of the cutting device associated therewith according to FIG. 1.
Figure 2B:
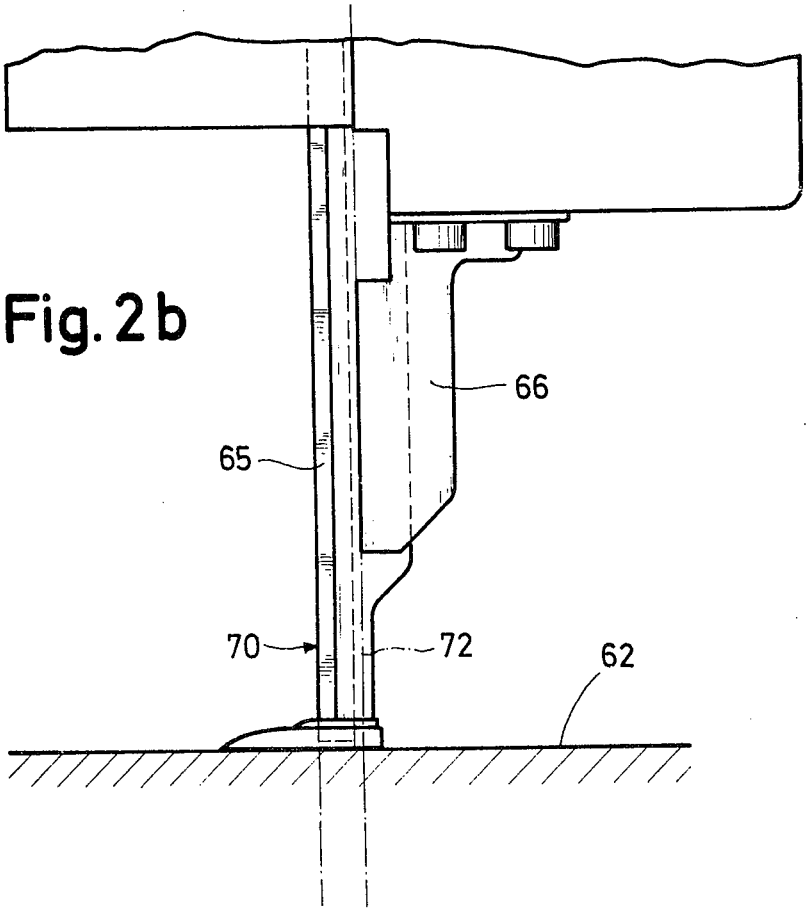

As is plain in FIG. 2*a* of the drawings, the cutting apparatus 10 according to the invention works with a knife assembly 52 in which a knife 65 which is reinforced by a guide 66 is drivable by a motor 68 in a known manner in an oscillating movement or in a vertical reciprocating movement. The knife assembly 52 is swingable around the swing shaft 54, the pivotal axis of which is designated in the drawing with the reference numeral 72. The knife 65 has a cutting edge 70 which, in the cutting direction (Arrow A in FIG. 2*a*), lies in front of the pivotal axis 72 of the knife assembly 52, as this is made evident particularly in FIG. 2*b*.

Now when, during the operation of the cutting apparatus, the photoelectric sensing head 16 follows the line to be sensed of the cutting pattern template 30, then the cutting apparatus, especially the knife assembly 52 carries out the same movement as the sensing head 16 on the basis of the mechanical connection between the sensing device 12 and the cutting device 14 via the connecting rod 60 in the X-Y plane. In addition, the swing motor 56 in the well known manner receives control signals which correspond to the angular position of the sensing head 16 and carries out in accordance with these signals a corresponding swing motion of the knife assembly 52 around the swing shaft 54 or the pivotal axis 72. By the tangential control just described, the knife 65 normally runs through the fabric layer package 64 in such an angular position that the main surfaces of the knife 65 are tangential to the line to be cut.

Although in the cutting apparatus 10 according to the invention, the knife 65, as in prior cutting mechanisms, is normally directed tangentially to the line to be cut as this was described above, conditions other than those in the usual cutting mechanisms result in cutting cutting-line parts which correspond to sharp angles in the cutting pattern template. On the basis of the fact that the angular position of the sensing head 16 corresponds at every instant to the course of the line to be sensed in the area of the sensed point, as well as on the basis of the fact that the swing motor 56 synchronously brings the knife assembly 52 into the same angular position held by the sensing head 16, the cutting line in the fabric layer package 64 will only correspond exactly to the sensed line of the cutting pattern template 30 if the cutting edge 70 of the knife 65 exactly coincides with the pivotal axis 72. Since, in this embodiment, the cutting edge 70 lies in front of the pivotal axis 72 when seen in the cutting direction, cutting edge 70 follows the tangential control with a certain time lag. This lag is not critical on straight or curved cutting line areas and does not in practice deleteriously affect the exactness of the cutting, since the cutting edge 70 still follows very exactly the very small curve radii of 2 to 3 mm in the cutting pattern template. Only with very sharp corners at which the change in direction takes place suddenly and without previous curving, does the prematureness of the cutting edge have an effect in contrast with the pivotal axis 72 which is utilized in the process according to the invention. For the more detailed description of the process according to the invention, one should first refer to FIGS. 3*a* and 3*b* which illustrate templates 30 which were developed especially for the application of the process according to the invention.

Figure 3A:
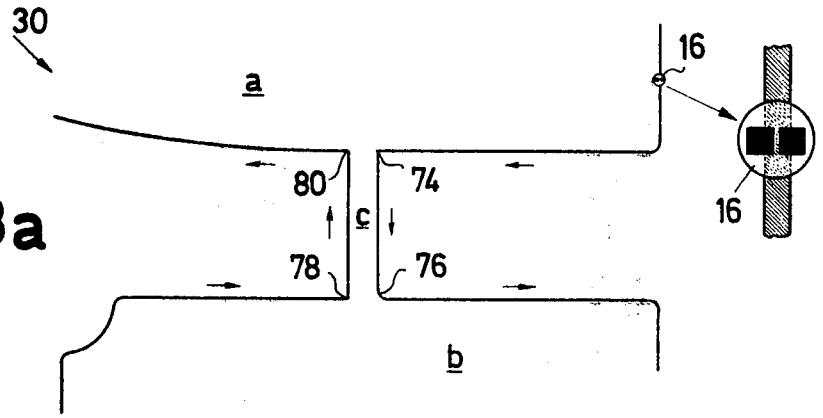
FIGS. 3*a* and 3*b* show sections of the cutting pattern templates for carrying out the process according to the invention, wherein at the same time the essential parts of the sensing device and the direction of the same along the cutting pattern template are indicated.

FIG. 3*a* shows in detail a section of a template by which areas of pattern parts *a* and *b* are covered which in the usual manner are connected with each other by a bar *c*. Templates of the kind illustrated in FIG. 3*a* are sensed according to the process of the so-called line sensing which is also applied in the U.S. Pat. No. 3,017,552 mentioned earlier. In line sensing, the sensing head 16 senses the line, for example, starting at the illustrated position, in the direction of the arrows drawn in and thereby arrives first at a sharp corner 74, at which corner the line to be sensed which at first followed the contour line of the pattern part *a*, changes into the contour line of bar *c*. The sensing head 16 then continues to run along bar *c* until it reaches a rounded corner 76, at which the contour line of bar *c* turns into the contour line of pattern part *b*. The sensing head 16 then continues to follow the contour line of pattern part *b* and senses the continued line of the pattern template until in FIG. 3*a* coming from below and to the left to a sharp corner 78 at which corner the contour line of the pattern part *b* turns into the left contour line of bar *c* which again turns into a further sharp corner 80 in a contour line of the pattern part *a*. It will be noted that in the template 30 according to the invention all corners with the exception of the sharp corners 74, 78 and 80 are formed as rounded corners, in connection with which in practice a curve radius of the rounded corners of approximately 1 to 2 mm has been found desirable, which suffices to avoid in the application of the basic thought of the invention an undesired cutting into the cutting parts, in connection with which such rounding off of the pattern corners also does not interfere.

Figure 4A:
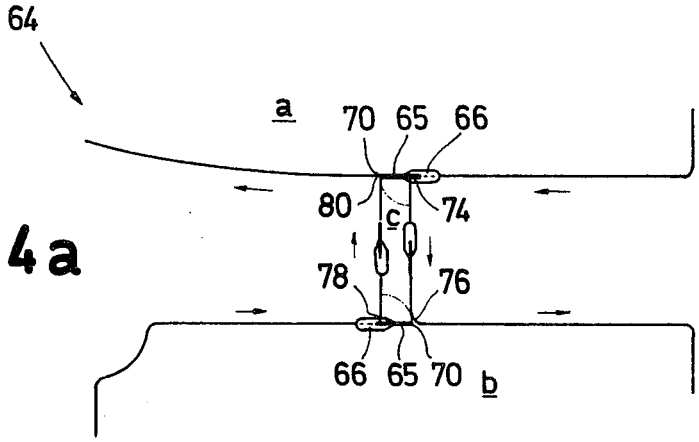
FIGS. 4*a* and 4*b* show illustrations corresponding to the illustrations in FIGS. 3*a* and 3*b* in which at the same time the position of the knife of the cutting device at various characteristic points is indicated, as well as the direction of the knife.
Figure 5:
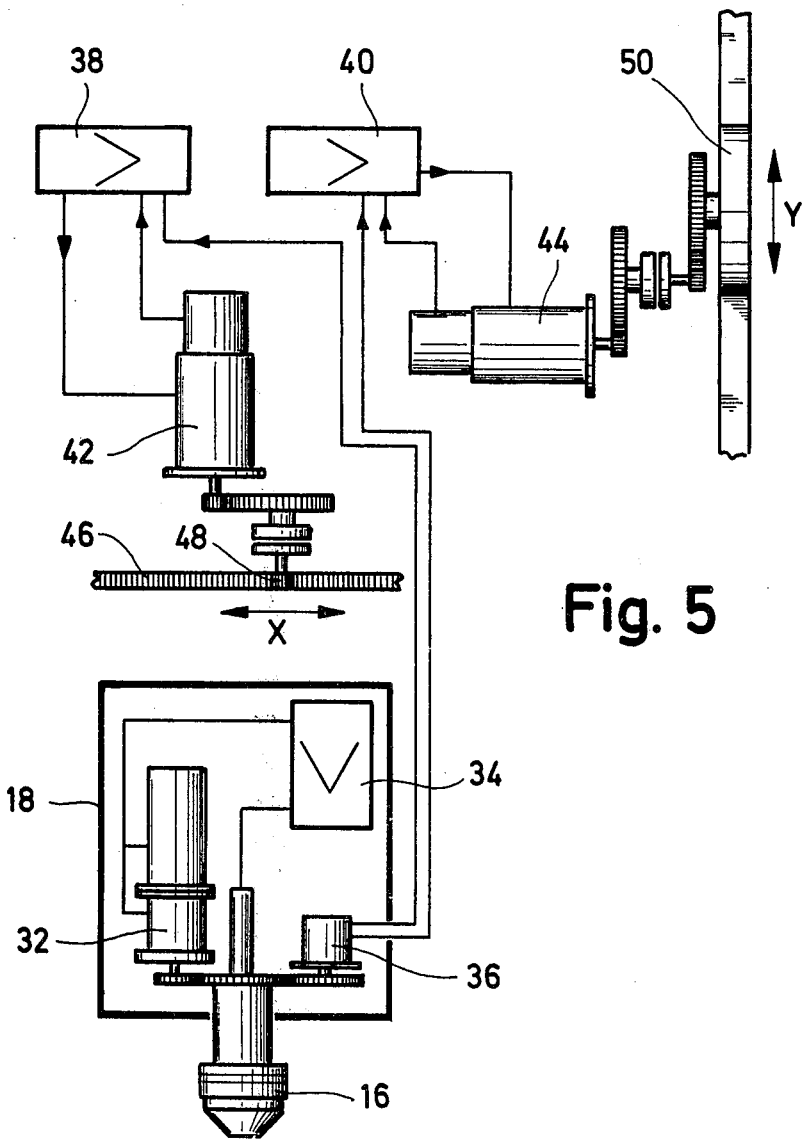
FIG. 5 shows a schematic representation of the sensing head and the control and driving mechanisms associated therewith.

In the use of a pattern template 30 as in FIG. 3*a* according to the process and apparatus of the invention illustrated in FIGS. 1, 2 and 5, the effect obtained is plain from FIG. 4*a*, that the cutting edge 70 of the knife 65 first runs beyond the turning point of the sharp corner 74 by a distance that is approximately equal to the width of the bar, the width of which is selected to correspond to the distance between the cutting edge 70 and the pivotal axis 72. When the pivotal axis 72 of the knife 65 reaches the turning point of the sharp corner 74, the knife 65 swings about 90° counter-clockwise and the knife edge then follows the right contour line of the bar *c* shown in FIG. 4*a* and finally rides through the rounded corner 76 in the usual manner. When the knife 65 on its return coming from the left and below reaches the sharp corner 78, the cutting edge 70 of the knife 65 running beyond the turning point of this corner 78 cuts through the connection between the pattern part *b* and the lower end of the bar *c*, whereupon the knife again swings about 90° and now follows the left contour line of the bar *c* shown in the drawing until the sharp corner 80 is reached.

The corner 80 now again, like corner 76, can be formed as a rounded corner so that the contour line corresponding to the pattern template 30 of the pattern part *a* would be essentially maintained. As the drawing shows and as has already been said above, the corner 80, however, is formed as a sharp corner so that its turning point likewise is overrun by the cutting edge 70 of the knife 65. At the corner 80 also the cutting edge 70 of the knife 65 swings again into the contour line of the pattern part *a* only beyond the turning point. The knife 65, therefore, leaves a cut in the pattern part *a* in the area of the sharp corner 80. Such a cut may be very desirable, however, since it may represent a plain marking for the sewer in the later fabrication, which marking may, for example be matched with a corresponding marking of another pattern part. In this connection, it is naturally advantageous if in the design of the pattern template 30 one has a free hand concerning the position of the bars *c*.

On the other hand, small cuts of a depth of 2 to 3 mm on the edge of a pattern part represent no problem in practice, so that, departing from the embodiment here considered, all four corners 74 through 80 in the area of a bar *c* could be formed as sharp corners and so that possibly other inner corners of the pattern can be formed as sharp corners.

Figure 3B:
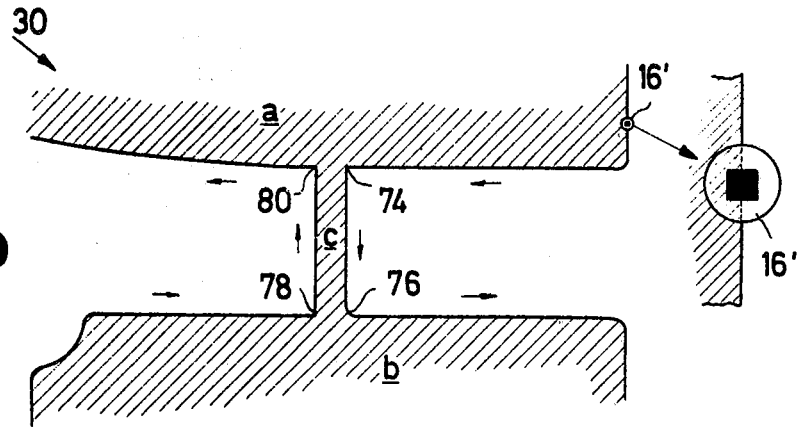
Figure 4B:
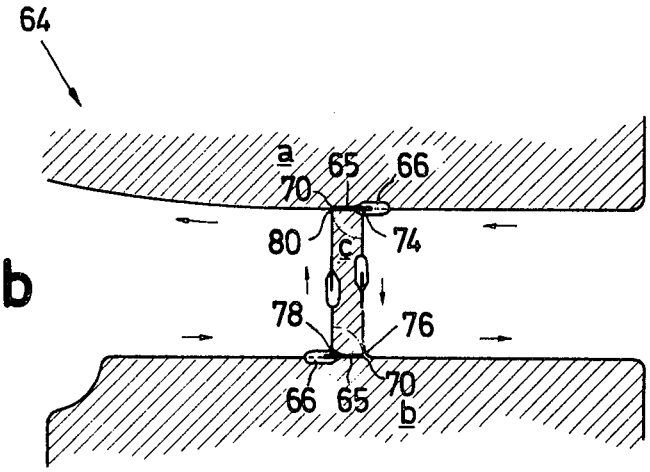

The FIGS. 3*b* and 4*b* of the drawings correspond to the FIGS. 3*a* and 4*a* of the drawings but are valid, however, for the sensing of the contour line between the light background material of a template 30 and the dark pattern parts *a* and *b*, as well as bars *c*. For the sake of clarity, the pattern template 30 according to FIG. 3*b* (just as this was the case in FIG. 4*a*) corresponds to FIG. 4*b*, which represents a schematic plane view of the cutting table 62 or of the fabric layer package 64, in connection with which the knife 65 and its guide 66 are shown directly over the fabric layer package 64. Accordingly, in FIGS. 3*b* and 4*b* all parts are again designated with the same reference numerals as in FIGS. 3*a* and 4*a*, with the single exception that, in place of the sensing head 16 indicated in FIG. 3*a*, a sensing head 16′ is provided. The difference between the sensing heads 16 and 16′ will be discussed in greater detail below.

With the sensing head described in the U.S. Pat. No. 3,017,552, it is only possible to sense lines. This sensing head works with a single photocell, the desired high sensitivity being achieved with the help of a slightly tilted rotating mirror opposite the optical axis of the system. In place of such sensing heads with a single photocell, so-called differential photocells with two light-sensitive elements arranged apart from each other, as this is indicated in the sectional enlargement of FIG. 3*a* are now used. The space between the light-sensitive elements or the photocells of a differential photocell is less than the width of the line which in pattern templates according to FIG. 3*a* can be very small and, for example, may amount to only about 0.3 mm. The differential photocell is indicated in the sectional enlargement in FIG. 3*a* in its typical position in relation to the line to be sensed.

As the expert knows, differential photocells with two photocells of suitable polarity of those photocells can also be used for sensing the boundary line or the contour line between a dark pattern part and an adjoining light part of the basic material. The sensing of such light-dark boundary lines may also take place with photocells having only a single photocell, as indicated in FIG. 3*b*, in connection with which in principle a similar circuit may be used as described in the already cited U.S. Patent, provided that the control circuit connected with the photocell is suitably constructed.

Although the process of sensing edges or the sensing of a light-dark boundary line in connection with FIGS. 3*b* and 4*b* is described on the basis of pattern templates produced in a contrast process, it is to be understood that in selecting suitable sensing heads 16′ and in the simultaneous selection of suitable line widths, a cutting pattern template according to FIG. 3*a* can be sensed in accordance with the process of edge sensing. Furthermore, it is to be understood that in the application of the process of edge sensing, the bar *c* in an extreme case may be formed of a single line which then, for example, can be 1 mm wide.

At this point, it should be emphasized that the FIGS. 4*a* and 4*b* are not true to scale and that the cross-section through the knife in comparison with the width of the bar is too small. With bar widths of 1 mm one can achieve the advantage that, if the knife 65 arrives for a second time at bar *c*, the cutting edge 70 when it swings will run into the first cut cutting line. If, according to FIG. 4*a*, the cutting line between the corners 74 and 76 is cut first, the knife 65 when it arrives at corner 78 with the correspondingly narrow bar will swing into the cutting line displacing the fabric between corners 74 and 76, which cutting line is now run through in the opposite direction so that no bar at all can be formed.

From the foregoing description, it is clear that in the process according to the invention, it is of importance that the cutting edge 70 of the knife 65 in the area of sharp corners, for example in the area of corner 74, runs deeper into the fabric than corresponds to the cutting pattern template 30. This overrunnning can be achieved by placing the pivotal axis 72 of the knife behind the cutting edge 70. With this construction of the apparatus for carrying out the process according to the invention, the control can be so arranged that the knife assembly 52 will follow the swing movements of the sensing head 16 with practically no lag. (The slight lag always present in practice is generally counteracted by giving the optical system of the sensing head a certain lead effect by directing the optic of the sensing head not vertically downward but slightly tilted to the front, so that a point in the line is always sensed which only a short time later is directly under the sensing head. The same effect may also be achieved, however, if the swing movements of the knife assembly 52 are purposely slightly slowed down in contrast with the swing movements of the sensing head 16 or 16'. In this case, the cutting edge 70 of the knife 65 in the area of sharp corners will overrun the cutting line indicated by the cutting pattern template 30 even then when the cutting edge 70 coincides with the pivotal axis 72 of the knife, i.e. when the knife is swung exactly around its cutting edge. Which of the two alternatives is more advantageous depends on the kind of sensing heads used and on the controls selected. Moreover, in deciding between the two alternatives, one must bear in mind the particular knives to be used and the particular materials to be cut according to what specific cutting pattern templates.

What I claim is:

1. In a process for automatically cutting fabric in a cutting plane by means of a knife having a cutting edge the movement of which is controlled by a sensor in accordance with a cutting pattern template containing the cutting information to be sensed in the form of a single continuous line made up of contour lines of pattern parts and contour line parts of small bars interconnecting the pattern parts and in which said contour lines and contour line parts run together to form sharp corners in said line, the step of running said cutting edge through at least one of said sharp corners for a distance substantially equal to the width of a bar following its approach to said one corner from one direction and before turning said edge to a new direction.

2. Apparatus for automatically cutting fabric in a cutting plane in accordance with a cutting pattern template containing the cutting information in the form of a single continuous line made up of contour lines of pattern parts and contour lines of small bars inter-connecting the pattern parts and in which certain of the contour lines of the pattern parts and the contour lines of the bars run together to form sharp corners in said line including in combination, a knife having a cutting edge extending through said plane, means mounting said knife for movement in a direction to cut fabric in said cutting plane, said mounting means including means mounting said knife for swinging movement of said edge around a pivotal axis generally perpendicular to said plane and spaced behind said cutting edge with reference to said cutting direction, means for sensing said line on said template and means responsive to said sensing means for controlling the movement of cutting means around said axis while said cutting edge extends through said plane, the arrangement being such that the point of intersection of such axis with such cutting plane corresponds to the point on said line sensed by said sensing means and just being effective at said controlling means, said sensing means incorporating a tangential control, said tangential control using said point of intersection as the reference point.

3. Apparatus as in claim 2 in which said means responsive to said sensing means provides movement of said knife around said axis which is substantially synchronous with movement of said sensing means.

4. Apparatus as in claim 2 in which the spacing between said cutting edge and said axis is substantially equal to the width of a bar.

* * * * *